US006143206A

United States Patent [19]

Handa et al.

[11] Patent Number: 6,143,206

[45] Date of Patent: Nov. 7, 2000

[54] ORGANIC POSITIVE TEMPERATURE COEFFICIENT THERMISTOR AND MANUFACTURING METHOD THEREFOR

[75] Inventors: Tokuhiko Handa; Yukie Yoshinari, both of Tokyo, Japan

[73] Assignee: TDK Corporation, Tokyo, Japan

[21] Appl. No.: 09/238,919

[22] Filed: Jan. 28, 1999

[30] Foreign Application Priority Data

Jun. 24, 1998 [JP] Japan ..... 10-193691

[51] Int. Cl.[7] ..... H01B 1/00

[52] U.S. Cl. ..... 252/500; 252/510; 252/511; 252/512; 252/513; 252/518.1; 219/541; 219/546; 338/22 R

[58] Field of Search ..... 252/511, 500, 252/510, 512, 513, 518.1; 219/541, 546, 547, 553; 264/104, 234, 347; 338/22 R

[56] References Cited

U.S. PATENT DOCUMENTS

| | | | |
|---|---|---|---|
| 5,378,407 | 1/1995 | Chandler et al. | 252/513 |
| 5,945,034 | 8/1999 | Handa et al. | 252/511 |

FOREIGN PATENT DOCUMENTS

| | | |
|---|---|---|
| 62-51184 | 3/1987 | Japan . |
| 62-51185 | 3/1987 | Japan . |
| 62-51186 | 3/1987 | Japan . |
| 62-51187 | 3/1987 | Japan . |
| 62-16523 | 4/1987 | Japan . |
| 1-231284 | 9/1989 | Japan . |
| 3-132001 | 6/1991 | Japan . |
| 5-47503 | 2/1993 | Japan . |
| 7-48396 | 5/1995 | Japan . |
| 7-109786 | 11/1995 | Japan . |
| 9-27383 | 1/1997 | Japan . |
| 9-69410 | 3/1997 | Japan . |

OTHER PUBLICATIONS

F. Bueche, J. Appl. Phys., vol. 44, No. 1, pp. 532–533, "A New Class of Switching Materials", Jan. 1973.

Kazuyuki Ohe, et al., Japanese Journal of Applied Physics, vol. 10, No. 1, pp. 99–108, "A New Resistor Having an Anomalously Large Positive Temperature Coefficient", Jan. 1971.

F. Bueche, Journal of Polymer Science, vol. 11, pp. 1319–1330, "Electrical Properties of Carbon Black in an SBR–Wax Matrix", 1973.

*Primary Examiner*—Mark Kopec
*Assistant Examiner*—Derrick G. Hamlin
*Attorney, Agent, or Firm*—Oblon, Spivak, McClelland, Maier & Neustadt, P.C.

[57] ABSTRACT

An organic positive temperature coefficient thermistor comprising a thermoplastic polymer matrix, a low-molecular organic compound having a melting point that is equal to or greater than 40° C. and less than 100° C. and conductive particles, each having spiky protuberances, is obtained by crosslinking a milled mixture of these components with a silane coupling agent comprising a vinyl group or a (meth) acryloyl group and an alkoxy group. This organic positive temperature coefficient thermistor has sufficiently low resistance at room temperature and a large rate of resistance change between an operating state and a non-operating state, and can be operated at less than 100° C. with a reduced temperature vs. resistance curve hysteresis, ease of control of operating temperature, and high performance stability.

10 Claims, 3 Drawing Sheets

ORGANIC POSITIVE TEMPERATURE COEFFICIENT THERMISTOR AND MANUFACTURING METHOD THEREFOR

BACKGROUND OF THE INVENTION

1. Prior Art

The present invention relates to an organic positive temperature coefficient thermistor that is used as a temperature sensor or overcurrent-protecting element, and has PTC (positive temperature coefficient of resistivity) characteristics that its resistance value increases with increasing temperature.

2. Background Art

An organic positive temperature coefficient thermistor having conductive particles dispersed in a crystalline polymer has been well known in the art, as typically disclosed in U.S. Pat. Nos. 3,243,753 and 3,351,882. The increase in the resistance value is believed to be due to the expansion of the crystalline polymer upon melting, which in turn cleaves a current-carrying path formed by the conductive fine particles.

An organic positive temperature coefficient thermistor can be used as a self control heater, an overcurrent-protecting element, and a temperature sensor. Requirements for these are that the resistance value is sufficiently low at room temperature in a non-operating state, the rate of change between the room-temperature resistance value and the resistance value in operation is sufficiently large, and the resistance value change upon repetitive operations is reduced.

To meet such requirements, it has been proposed to incorporate a low-molecular organic compound such as wax in a polymer matrix. Such an organic positive temperature coefficient thermistor, for instance, includes a polyisobutylene/paraffin wax/carbon black system (F. Bueche, J. Appl. Phys., 44, 532, 1973), a styrene-butadiene rubber/paraffin wax/carbon black system (F. Bueche, J. Polymer Sci., 11, 1319, 1973), and a low-density polyethylene/paraffin wax/carbon black system (K. Ohe et al., Jpn. J. Appl. Phys., 10, 99, 1971). Self control heaters, current-limiting elements, etc. comprising an organic positive temperature coefficient thermistor using a low-molecular organic compound are also disclosed in JP-B's 62-16523, 7-109786 and 7-48396, and JP-A's 62-51184, 62-51185, 62-51186, 62-51187, 1-231284, 3-132001, 9-27383 and 9-69410. In these cases, the resistance value increase is believed to be due to the melting of the low-molecular organic compound.

One of advantages to the use of the low-molecular organic compound is that there is a sharp rise in the resistance increase with increasing temperature because the low-molecular organic compound is generally higher in crystallinity than a polymer. A polymer, because of being easily put into an over-cooled state, shows a hysteresis where the temperature at which there is a resistance decrease with decreasing temperature is usually lower than the temperature at which there is a resistance increase with increasing temperature. With the low-molecular organic compound it is then possible to keep this hysteresis small. By use of low-molecular organic compounds having different melting points, it is possible to easily control the temperature (operating temperature) at which there is a resistance increase. A polymer is susceptible to a melting point change depending on a difference in molecular weight and crystallinity, and its copolymerization with a comonomer, resulting in a variation in the crystal state. In this case, no sufficient PTC characteristics are often obtained. This is particularly true of the case where the operating temperature is set at less than 100° C.

One of the above publications, Jpn. J. Appl. Phys., 10, 99, 1971 shows an example wherein the specific resistance value (Ωcm) increases by a factor of $10^8$. However, the specific resistance value at room temperature is as high as $10^4$ Ωcm, and so is impractical for an overcurrent-protecting element or temperature sensor in particular. Other publications show resistance value (Ω) or specific resistance (Ωcm) increases in the range between 10 times or lower and $10^4$ times, with the room-temperature resistance being not fully decreased.

In many cases, carbon black, and graphite have been used as conductive particles in prior art organic positive temperature coefficient thermistors including the above-mentioned ones. A problem with carbon black is, however, that when an increased amount of carbon black is used to lower the initial resistance value, no sufficient rate of resistance change is obtainable; no reasonable tradeoff between low initial resistance and a large rate of resistance change is obtainable. Sometimes, particles of generally available metals are used as conductive particles. In this case, too, it is difficult to arrive at a sensible tradeoff between low initial resistance and a large rate of resistance change.

One approach to solving this problem is disclosed in JP-A 5-47503 that teaches the use of conductive particles having spiky protuberances. More specifically, it is disclosed that polyvinylidene fluoride is used as a crystalline polymer and spiky nickel powders are used as conductive particles having spiky protuberances. U.S. Pat. No. 5,378,407, too, discloses a thermistor comprising filamentary nickel having spiky protuberances, and a polyolefin, olefinic copolymer or fluoropolymer.

However, these thermistors are still insufficient in terms of hysteresis and so are unsuitable for applications such as temperature sensors, although the effect on the tradeoff between low initial resistance and a large resistance change is improved. In addition, these thermistors have an operating temperature of 100° C. or higher. Although some thermistors have an operating temperature in the range of 60 to 90° C., they are impractical because their performance becomes unstable upon repetitive operations. When thermistors are used as protective elements for secondary batteries, electric blankets, heaters for lavatory seats and vehicle seats, etc., an operating temperature of 100° C. or higher poses a great danger to the human body. With the safety of the human body in mind, the operating temperature must be below 100° C. In recent years, organic positive temperature coefficient thermistors have been increasingly demanded as overcurrent protecting elements for portable telephones, personal computers, etc. In view of the temperature of 40 to 90° C. at which they are usually used, too, thermistors having an operating temperature from 40° C. to lower than 100° C. are desired.

Thus, never until now is an organic positive temperature coefficient thermistor accomplished, which can show good performance at an operating temperature of less than 100° C. and have high performance stability.

In Japanese Patent Application No. 9-350108, the inventors have already come up with an organic positive temperature coefficient thermistor comprising a thermoplastic polymer matrix, a low-molecular organic compound and a conductive particle having spiky protuberances. This thermistor has a sufficiently low room-temperature specific resistance of $8\times10^{-2}$ Ωcm, a rate of resistance change of ten orders of magnitude greater between an operating state and a non-operating state, and a reduced temperature vs. resistance curve hysteresis. In addition, the operating temperature is equal to or greater than 40° C. and less than 100° C.

However, this thermistor is found to be insufficient in terms of performance stability, with a noticeably increased resistance at high temperature and humidity in particular. This appears to be due to the segregation, etc. of the working or active substance, i.e., the low-molecular organic compound upon repetitive melting/solidification cycles during operation, which segregation is ascribable to the low melting point and low melt viscosity of the low-molecular organic compound. This in turn causes a change in the dispersion state of the low-molecular organic compound and conductive particles, resulting in a performance drop. Such a performance stability problem is important to the low-molecular organic compound serving as the active substance.

SUMMARY OF THE INVENTION

An object of the invention is to provide an organic positive temperature coefficient thermistor that has sufficiently low resistance at room temperature and a large rate of resistance change between an operating state and a non-operating state, and can be operated at less than 100° C. with a reduced temperature vs. resistance curve hysteresis, ease of control of operating temperature, and high performance stability.

Such an object is achieved by the inventions defined below.

(1) An organic positive temperature coefficient thermistor comprising a thermoplastic polymer matrix, a low-molecular organic compound having a melting point that is equal to or greater than 40° C. and less than 100° C. and conductive particles, each having spiky protuberances, wherein:

a mixture of said thermoplastic polymer matrix, said low-molecular organic compound and said conductive particle is crosslinked with a silane coupling agent comprising a vinyl group or a (meth)acryloyl group and an alkoxy group.

(2) The organic positive temperature coefficient thermistor according to (1), wherein said low-molecular organic compound has a weight-average molecular weight of 1,000 or lower.

(3) The organic positive temperature coefficient thermistor according to (1), wherein said low-molecular organic compound is a petroleum wax.

(4) The organic positive temperature coefficient thermistor according to (1), wherein said conductive particles, each having spiky protuberances, are interconnected in a chain form.

(5) The organic positive temperature coefficient thermistor according to (1), wherein said thermoplastic polymer matrix is a polyolefin.

(6) The organic positive temperature coefficient thermistor according to (5), wherein said polyolefin is a high-density polyethylene.

(7) The organic positive temperature coefficient thermistor according to (6), wherein said high-density polyethylene has a melt flow rate of 3.0 g/10 min. or less.

(8) The organic positive temperature coefficient thermistor according to (1), wherein said silane coupling agent is vinyltrimethoxysilane or vinyltriethoxysilane.

(9) The organic positive temperature coefficient thermistor according to (1), which has an operating temperature of less than 100° C.

(10) A method of preparing an organic positive temperature coefficient thermistor as recited in (1), wherein a thermoplastic polymer matrix, a low-molecular organic compound having a melting point that is equal to or greater than 40° C. and less than 100° C. and conductive particles, each having spiky protuberances, are milled together into a milled mixture, and said milled mixture is then crosslinked with a silane coupling agent comprising a vinyl group or a (meth)acryloyl group and an alkoxy group.

ACTION

The organic positive temperature coefficient thermistor of the invention comprises a thermoplastic polymer matrix, a low-molecular organic compound having a melting point that is equal to or greater than 40° C. and less than 100° C. and conductive particles, each having spiky protuberances. A mixture of these components is crosslinked with a silane coupling agent comprising a vinyl group or a (meth)acryloyl group and an alkoxy group.

In the present invention, the spiky shape of protuberances on the conductive particles enables a tunnel current to pass readily through the thermistor, and makes it possible to obtain initial resistance lower than would be possible with spherical conductive particles. When the thermistor is in operation, a large resistance change is obtainable because spaces between the spiky conductive particles are larger than those between spherical conductive particles.

In the present invention, the low-molecular organic compound is incorporated in the thermoplastic polymer matrix, preferably a polyolefin matrix so that the PTC characteristics that the resistance value increases with increasing temperature are achieved by the melting of the low-molecular organic compound. Accordingly, the temperature vs. resistance curve hysteresis can be more reduced than that obtained by use of the polymer matrix alone. Control of operating temperature by use of low-molecular organic compounds having varying melting points, etc. is easier than control of operating temperature making use of a change in the melting point of a polymer. According to the invention, the operating temperature can further be brought down to less than 100° C. by using for the active substance the low-molecular organic compound having a melting point that is equal to or greater than 40° C. and less than 100° C.

In the present invention, the mixture of the thermoplastic polymer matrix, low-molecular organic compound and conductive particles having spiky protuberances is crosslinked with a silane coupling agent comprising a vinyl group or a (meth)acryloyl group and an alkoxy group to achieve considerable improvements in the performance stability of the thermistor during storage, and upon repetitive operations.

The performance stability improvement of the organic positive temperature coefficient thermistor appears to be due to a crosslinked structure of the polymer matrix and the low-molecular organic compound, which allows the polymer matrix to ensure shape retention, thereby suppressing the agglomeration and segregation of the low-molecular organic compound exposed to repetitive melting/solidification cycles when the thermistor is in operation. The coupling agent appears not only to crosslink the above organic matrix, but also to form a chemical bond between the organic and inorganic materials, producing some great effect on the modification of the interface between them. The treatment of the mixture of the thermoplastic polymer matrix, low-molecular organic compound and conductive particles with the silane coupling agent contributes to additional performance stability improvements. This appears to be because there is an increase in the strength of the polymer matrix-conductive particle interface, low-molecular organic compound-conductive particle interface, polymer matrix-metal electrode interface, and low-molecular organic compound-metal electrode interface.

In the invention, the coupling agent is first grafted onto the thermoplastic polymer matrix and low-molecular organic compound via a group having a carbon-carbon double bond (C═C). By alcohol removal in the presence of water and condensation with dehydration, crosslinking reactions then occur according to the following scheme.

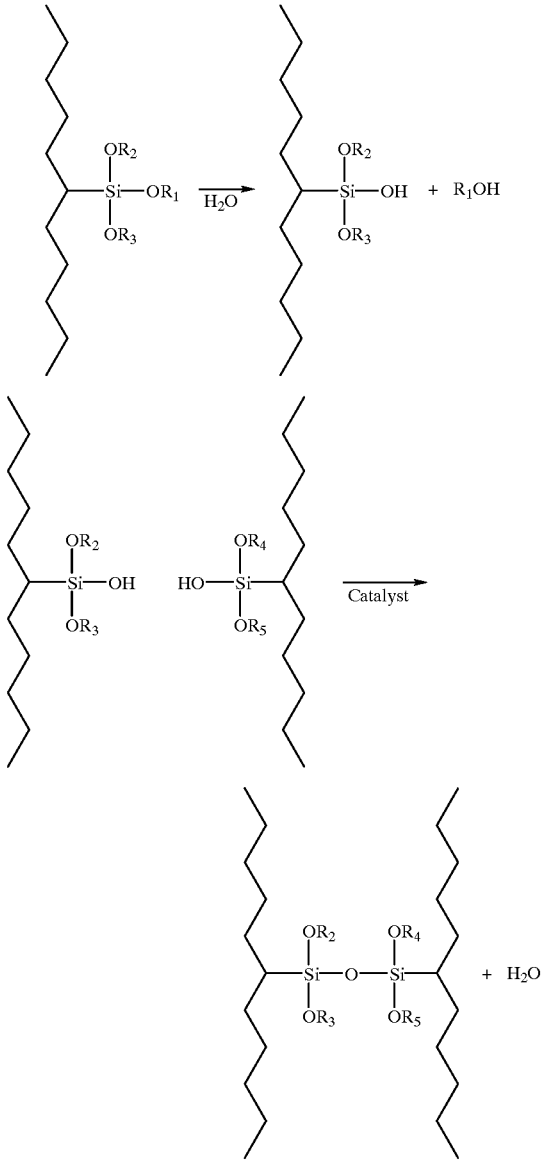

Other crosslinking processes may also be available, including a chemical crosslinking process using an organic peroxide, and a radiation crosslinking process using electron beam irradiation. However, it is to be noted that the chemical crosslinking process makes shape retention difficult due to the need of heat-treating the polymer matrix at a temperature much higher than the melting point thereof after molding, leading to a possible thermal degradation of the device. It is also to be noted that with the radiation crosslinking process using costly equipment, it is difficult to provide sufficient crosslinking of the interior of the device especially when it is thick, and so achieve uniform crosslinking.

In this regard, it has already been proposed to carry out silane crosslinking treatments. For low-molecular organic compound-free systems, for instance, JP-A 59-60904 discloses a semiconductive composition wherein 15 to 50% by weight of conductive carbon is uniformly dispersed in a water-crosslinked, silyl-modified polyolefin having a gel fraction of 60% or greater. JP-A 4-68501 discloses a resistor having PTC characteristics, wherein conductive powders are dispersed in a water-crosslinked polymer, for instance, an organic silane-modified polymer. JP-A 4-157701 discloses a resistor having PTC characteristics, which is obtained by mixing together a polymer to be not crosslinked with water (a polyolefinic resin) and conductive powders (carbon black) to prepare a mixture, and mixing the mixture with a polymer to be crosslinked with water (polyethylene having an active silane group), followed by water cross-linking.

However, these are free of any low-molecular organic compound, use the polyolefin as an active substance, and have a high operating temperature of 100° C. or greater. Since carbon black, etc. are used as the conductive particles, performance is less than satisfactory as represented in terms of a room-temperature specific resistance of as high as $10^1$ Ωcm or greater and a rate of resistance change of about 2 to 5 orders of magnitude. The aforesaid publications give no suggestion about performance stability at all.

JP-B 3-74481 discloses a heater element resin composition comprising a polyolefinic crystalline polymer resin, a silane compound, an organic peroxide, a stabilizer and a conductive powder, for instance, carbon. The publication alleges that high performance stability is achieved because the silane compound is chemically bonded to the crystalline polymer using the organic peroxide in the presence of the stabilizer to form a chemical bond to a functional group on the surface of carbon or improve affinity for carbon, so that any resistance change due to the local presence of carbon is avoided, and the adhesion of the resin composition to an electrode material is improved by the chemical combination of the silane compound therewith. JP-A 4-345785 discloses a resistor having a positive resistance temperature coefficient, which is obtained by dispersing conductive powders in a crystalline polymer composition to prepare a conductive composition, crosslinking the conductive composition, pulverizing the crosslinked product, surface-treating the powders with a silane coupling agent, and mixing and dispersing the surface-treated powders in the crystalline polymer composition. The publication alleges that the increase in the resistance of the heater element is reduced, resulting in an increase in its service life, because the silane coupling agent is coated on the particulate conductive composition, whereby strong chemical bonds are formed between the binder polymer and a metal electrode to form a current-carrying path during the passage of current and suppress the occurrence of cracks in the conductive powders due to thermal expansion upon heat generation by the passage of current.

However, the performance stability improvement by such surface treatments alone is limited. Clearly, stable performance is obtainable over a longer period of time according to the present invention. Both the aforesaid publications fail to show initial performance in the examples; to what degree the elements under test degrade remains unclear. Since carbon is used as the conductive powders, it is impossible to achieve a reasonable tradeoff between the low initial resistance and the large rate of resistance change, as contemplated in the invention. In addition, these elements are free of any low-molecular organic compound, use the crystalline polymer resin as an active substance, and have an operating temperature of 100° C. or greater.

For systems using low-molecular organic compounds, too, it has been proposed to carry out silane crosslinking treatments.

JP-A 1-231284 discloses a self temperature control type heater element comprising a water-crosslinked type polyolefin, for instance, an organic silane-modified polyolefin with a conductive filler and a low-molecular-weight polyolefin wax incorporated therein. JP-A 9-69410 discloses a current-limiting element comprising a water-crosslinked type polyolefin, for instance, an organic silane-modified polyolefin with a conductive filler and a low-molecular-weight polyolefin wax incorporated therein. However, these publications refer to a mixture of the water-crosslinked type polyolefin with the low-molecular-weight polyolefin wax, but not to a crosslinked structure comprising a polymer matrix and a low-molecular organic compound as contemplated in the present invention. The performance stability improvement achieved is thus very limited. In other words, high performance cannot be maintained over as a long term as achieved in the present invention. Furthermore, the publications do not give any suggestion about performance stability at all. JP-A 9-69410 shows that carbon black, graphite, carbon fibers, and metal powders (e.g., Ni powders) are used for the conductive filler, but does not refer to conductive particles having spiky protuberances. For this reason, the element disclosed therein has a low rate of resistance of about 3 orders of magnitude although its room-temperature specific resistance is as low as $10^{-1}$ to $10^{0}$ Ωcm. In other words, the element has no sufficient performance for use as an overcurrent-protecting element or a temperature sensor. The element disclosed in JP-A 1-231284, too, has no sufficient performance because the room-temperature specific resistance is as high as $10^{1}$ to $10^{2}$ Ωcm and the rate of resistance change is as low as about 3 orders of magnitude. This is because carbon black is used as the conductive filler. In these elements wherein both the organic silane-modified polyolefin and the low-molecular-weight polyolefin wax act as an active substance, the operating temperature is higher than that of the element of the invention because the wax having a melting point of 100 to 160° C. is used. In other words, these prior art elements cannot be operated at less than 100° C. According to the invention, however, the operating temperature can be brought down to less than 100° C. because only the low-molecular organic substance having a melting point that is equal to or greater than 40° C. and less than 100° C. is used as the active substance.

EXPLANATION OF THE PREFERRED EMBODIMENTS

Figure 1:
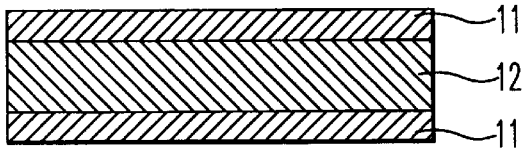
FIG. 1 is a sectional schematic of one embodiment of the organic positive coefficient thermistor according to the invention.

The present invention will now be explained in more detail.

The organic positive temperature coefficient thermistor of the invention comprises a thermoplastic polymer matrix, a low-molecular organic compound having a melting point that is equal to or greater than 40° C. and less than 100° C., and conductive particles having spiky protuberances, and is obtained by crosslinking together a mixture of these components with a silane coupling agent comprising a vinyl group or a (meth)acryloyl group and an alkoxy group.

The melting point of the thermoplastic polymer matrix should be higher than the melting point of the low-molecular organic compound by preferably at least 30° C., and more preferably 30° C. to 110° C. inclusive so as to prevent fluidization-during-operation of the low-molecular organic compound due to melting, deformation of the element, etc. In other words, the melting point of the thermoplastic polymer matrix is preferably in the range of usually 70 to 200° C.

The thermoplastic polymer matrix used herein may be either crystalline or amorphous. Exemplary thermoplastic polymers are polyolefins such as polyethylene, ethylene-vinyl acetate copolymer, polyalkylacrylates, e.g., polyethylacrylate, polyalkyl (meth)acrylates, e.g., polymethyl (meth)acrylate, fluorine polymers such as polyvinylidene fluoride, and polytetrafluoroethylene, polyhexafluoro-propylene, or copolymers thereof, halogen polymers such as chlorine polymers, e.g., polyvinyl chloride, polyvinylidene chloride, chlorinated polyvinyl chloride, chlorinated polyethylene and chlorinated polypropylene or copolymers thereof, polystyrene, and thermoplastic elastomers. The polyolefins may be copolymers. Exemplary mention is made of high-density polyethylene (e.g., Hizex 2100JP made by Mitsui Petrochemical Industries, Ltd., and Marlex 6003 made by Phillips Petroleum Co.), low-density polyethylene (e.g., LC500 made by Nippon Polychem. Co., Ltd., and DYNH-1 made by Union Carbide Corp.), medium-density polyethylene (e.g., 2604M made by Gulf Oil Corp.), ethylene-ethyl acrylate copolymer (e.g., DPD6169 made by Union Carbide Corp.), ethylene-vinyl acetate copolymer (e.g., Novatec EVALV241 made by Nippon Polychem Co., Ltd.), polyvinyl fluoride (e.g., Kynar 711 made by Elf-Atchem Co., Ltd.), and vinylidene fluoride-tetrafluoroethylene-hexafluoropropylene copolymer (e.g., Kynar ADS made by Elf-Atchem Co., Ltd.). Such a thermoplastic polymer should preferably have a weight-average molecular weight Mw of about 10,000 to 5,000,000.

For the thermoplastic polymer matrix it is preferable to use polyolefins, and especially high-density polyethylene. By the term "polyethylene" is herein intended a polyethylene having a density of at least 0.942 g/cm$^3$. This polyethylene is produced in a linear chain form by coordination anionic polymerization at a medium or low pressure of the order of a few tens of atmospheric pressures using a transition metal catalyst.

The high-density polyethylene should preferably have a melt flow rate (MFR) of up to 3.0 g/10 min., and especially up to 1.5 g/10 min. as measured according to the ASTM D1238 definition. At a higher MFR, performance stability tends to become worse due to too low a melt viscosity. The lower limit to MFR is usually about 0.1 g/10 min., although it is not critical to the practice of the invention.

In the invention, the thermoplastic polymer matrices may be used alone or in combination of two or more. However, preference is given to the use of only a high-density polyethylene having an MFR of up to 3.0 g/10 min.

Preferably but not exclusively, the low-molecular organic compound used herein is a crystalline yet solid (at normal temperature or about 25° C.) substance having a molecular weight of up to about 1,000, and preferably 200 to 800 and a melting point that is equal to or greater than 40° C. and less than 100° C.

Such a low-molecular organic compound, for instance, includes waxes (e.g., petroleum waxes such as paraffin wax and microcrystalline wax as well as natural waxes such as vegetable waxes, animal waxes and mineral waxes), and fats and oils (e.g., fats, and those called solid fats). Actual components of the waxes, and fats and oils may be hydrocarbons (e.g., an alkane type straight-chain hydrocarbon having 22 or more carbon atoms), fatty acids (e.g., a fatty acid of an alkane type straight-chain hydrocarbon having 12 or more carbon atoms), fatty esters (e.g., a methyl ester of a saturated fatty acid obtained from a saturated fatty acid having 20 or more carbon atoms and a lower alcohol such as methyl alcohol), fatty amides (e.g., an amide of an unsaturated fatty amide such as oleic amide, and erucic amide), aliphatic amines (e.g., an aliphatic primary amine having 16 or more carbon atoms), and higher alcohols (e.g., an n-alkyl alcohol having 16 or more carbon atoms). However, these components may be used by themselves as the low-molecular organic compound. For the low-molecular organic compound it is preferable to use the petroleum waxes.

These low-molecular organic compounds are commercially available, and commercial products may be immediately used.

In the present invention, one object is to provide a thermistor that can be operated preferably at less than 100° C., the low-molecular organic compound used has preferably a melting point, mp, that is equal to or greater than 40° C. and less than 100° C. Such a low-molecular organic compound, for instance, includes paraffin waxes (e.g., tetracosane $C_{24}H_{50}$ mp 49–52° C.; hexatriacontane $C_{36}H_{74}$ mp 73° C.; HNP-10 mp 75° C., Nippon Seiro Co., Ltd.; and HNP-3 mp 66° C., Nippon Seiro Co., Ltd.), microcrystalline waxes (e.g., Hi-Mic-1080 mp 83° C., Nippon Seiro Co., Ltd.; Hi-Mic-1045 mp 70° C., Nippon Seiro Co., Ltd.; Hi-Mic-2045 mp 64° C., Nippon Seiro Co., Ltd.; Hi-Mic-3090 mp 89° C., Nippon Seiro Co., Ltd.; Seratta 104 mp 96° C., Nippon Sekiyu Seisei Co., Ltd.; and 155 Microwax mp 70° C., Nippon Sekiyu Seisei Co., Ltd.), fatty acids (e.g., behenic acid mp 81° C., Nippon Seika Co., Ltd.; stearic acid mp 72° C., Nippon Seika Co., Ltd.; and palmitic acid mp 64° C., Nippon Seika Co., Ltd.), fatty esters (arachic methyl ester mp 48° C., Tokyo Kasei Co., Ltd.), and fatty amides (e.g., oleic amide mp 76° C., Nippon Seika Co., Ltd.). Use may also be made of wax blends which comprise paraffin waxes and resins and may further contain microcrystalline waxes, and which have a melting point that is equal to or greater than 40° C. and less than 100° C.

The low-molecular organic compounds may be used alone or in combination of two or more although depending on operating temperature and so on.

The conductive particles used herein, each having spiky protuberances, are each made up of a primary particle having pointed protuberances. More specifically, a number of (usually 10 to 500) conical and spiky protuberances, each having a height of ⅓ to 1/50 of particle diameter, are present on one single particle. The conductive particles are preferably made up of Ni or the like.

Although such conductive particles may be used in a discrete powder form, it is preferable that they are used in a chain form of about 10 to 1,000 interconnected primary particles to form a secondary particle. The chain form of interconnected primary particles may partially include primary particles. Examples of the former include a spherical form of nickel powders having spiky protuberances, one of which is commercially available under the trade name of INCO Type 123 Nickel Powder (INCO Co., Ltd.). These powders have an average particle diameter of about 3 to 7 μm, an apparent density of about 1.8 to 2.7 g/cm$^3$, and a specific surface area of about 0.34 to 0.44 m$^2$/g.

Preferred examples of the latter are filamentary nickel powders, some of which are commercially available under the trade names of INCO Type 255 Nickel Powder, INCO Type 270 Nickel Powder, INCO Type 287 Nickel Powder, and INCO Type 210 Nickel Powder, all made by INCO Co., Ltd., with the former three being preferred. The primary particles have an average particle diameter of preferably at least 0.1 μm, and more preferably from about 0.5 to about 4.0 μm inclusive. Primary particles having an average particle diameter of 1.0 to 4.0 μm inclusive are most preferred, and may be mixed with 50% by weight or less of primary particles having an average particle diameter of 0.1 μm to less than 1.0 μm. The apparent density is about 0.3 to 1.0 g/cm$^3$ and the specific surface area is about 0.4 to 2.5 m$^2$/g.

In this regard, it is to be noted that the average particle diameter is measured by the Fischer subsieve method.

Such conductive particles are set forth in JP-A 5-47503 and U.S. Pat. No. 5,378,407.

In addition to the conductive particles having spiky protuberances, it is acceptable to use for the conductive particles carbon conductive particles such as carbon black, graphite, carbon fibers, metallized carbon black, graphitized carbon black and metallized carbon fibers, spherical, flaky or fibrous metal particles, metal particles coated with different metals (e.g., silver-coated nickel particles), ceramic conductive particles such as those of tungsten carbide, titanium nitride, zirconium nitride, titanium carbide, titanium boride and molybdenum silicide, and conductive potassium titanate whiskers disclosed in JP-A's 8-31554 and 9-27383. The amount of such conductive particles should preferably be up to 25% by weight of the conductive particles having spiky protuberances.

Referring to the mixing ratio between the thermoplastic polymer matrix and the low-molecular organic compound, it is preferable that the low-molecular organic compound is used at a ratio of 0.2 to 4 (by weight) per thermoplastic polymer molecule. When this ratio becomes low or the amount of the low-molecular organic compound becomes small, it is difficult to obtain any satisfactory rate of resistance change. When this ratio becomes high or the amount of the low-molecular organic compound becomes large, on the contrary, the thermistor element is not only unacceptably deformed upon the melting of the low-molecular compound, but it is also difficult to mix the low-molecular compound with the conductive particles. The amount of the conductive particles should preferably be 2 to 5 times as large as the total weight of the polymer matrix and low-molecular organic compound. When this mixing ratio becomes low or the amount of the conductive particles becomes small, it is impossible to make the room-temperature resistance in a non-operating state sufficiently low. When the amount of the conductive particles becomes large, on the contrary, it is not only difficult to obtain any large rate of resistance change, but it is also difficult to achieve any uniform mixing, resulting in a failure in obtaining any reproducible resistance value.

In the practice of the invention, milling should preferably be carried out at a temperature that is greater than the melting point of the thermoplastic polymer matrix (especially the melting point+5 to 40° C.). Milling may otherwise be done in known manners using, e.g., a mill for a period of about 5 to 90 minutes. Alternatively, the thermoplastic polymer and low-molecular organic compound may have been previously mixed together in a molten state or dissolved in a solvent before mixing. The milled mixture is then crosslinked together with the silane coupling agent added thereto.

The silane coupling agent may be condensed by alcohol removal and dehydration, and have per molecule an alkoxy group chemically bondable to an inorganic oxide and a vinyl group or a (meth)acryloyl group having an affinity for an organic material or chemically bondable to the organic material. For the silane coupling agent, it is preferable to use trialkoxysilane having a C═C bond.

Preference is given to an alkoxy group having a small number of carbon atoms in general, and a methoxy or ethoxy group in particular. The C═C bond-containing group is a vinyl group or a (meth)acryloyl group, with the vinyl group being preferred. These groups may have been bonded directly or via a $C_1$ to $C_3$ carbon chain to Si.

A preferred silane coupling agent is liquid at normal temperature.

Exemplary silane coupling agents are vinyltrimethoxysilane, vinyltriethoxysilane, vinyl-tris(β-methoxyethoxy) silane, γ-(meth) acryloxypropyltrimethoxysilane, γ-(meth) acryloxypropyltriethoxysilane, γ-(meth) acryloxypropylmethyldimethoxysilane and γ-(meth) acryloxypropylmethyldiethoxysilane, with vinyltrimethoxysilane and vinyltriethoxysilane being most preferred.

For the coupling treatment, the silane coupling agent in an amount of 0.1 to 5% by weight per the total weight of the thermoplastic polymer and low-molecular organic compound is added dropwise to a milled mixture of the thermoplastic polymer matrix, low-molecular organic compound and conductive particles, followed by full stirring, and water crosslinking. When the amount of the coupling agent is smaller than this, the effect of the crosslinking treatment becomes slender. However, the use of the coupling agent in a larger amount does not give rise to any increase in that effect. When the silane coupling agent having a vinyl group is used, an organic peroxide such as 2,2-di-(t-butylperoxy)butane, dicumyl peroxide, and 1,1-di-t-butylperoxy-3,3,5-trimethylcyclohexane is incorporated in the coupling agent in an amount of 5 to 20% by weight thereof for grafting onto the organic materials, i.e., the thermoplastic polymer and low-molecular organic compound via the vinyl group. The addition of the silane coupling agent is carried out after the thermoplastic polymer, low-molecular organic compound and conductive particles have been milled together in a sufficiently uniform state.

The milled mixture is pressed into a sheet having a given thickness, which is then crosslinked in the presence of water. For instance, the pressed sheet may be immersed in warm water for 6 to 8 hours, using as a catalyst a metal carboxylate such as dibutyltin dilaurate, dioctyltin dilaurate, tin acetate, tin octoate, and zinc octoate. Alternatively, the crosslinking may be carried out at high temperature and humidity while the catalyst is milled with a thermistor element. For the catalyst it is particularly preferable to use dibutyltin dilaurate. Preferably, the crosslinking temperature should be equal to or less than the melting point of the low-molecular organic compound to enhance performance stability upon repetitive operations, etc. After completion of the crosslinking treatment, the sheet is dried, and a metal electrode made of Cu, and Ni is thermocompressed thereto to prepare a thermistor element.

The organic positive temperature coefficient thermistor according to the invention has low initial resistance or a room-temperature specific resistance value of about $10^{-2}$ to $10^{0}$ Ωcm in its non-operating state, with a sharp resistance rise upon operation and the rate of resistance change upon transition from its non-operating state to operating state being 6 orders of magnitude greater. The performance of the thermistor suffers from no or little degradation even after the passage of 500 hours at 80° C. and 80% RH (a humidity-dependent operating life of 20 years or longer at Tokyo, and 10 year or longer at Naha).

To prevent thermal degradation of the low-molecular organic compound, an antioxidant may also be incorporated in the organic positive temperature coefficient thermistor of the invention. Phenols, organic sulfurs, phosphites (based on organic phosphorus), etc. may be used for the antioxidant.

Additionally, the thermistor of the invention may contain as a good heat- and electricity-conducting additive silicon nitride, silica, alumina and clay (mica, talc, etc.) described in JP-A 57-12061, silicon, silicon carbide, silicon nitride, beryllia and selenium described in JP-B 7-77161, inorganic nitrides and magnesium oxide described in JP-A 5-217711, and the like.

For robustness improvements, the thermistor of the invention may contain titanium oxide, iron oxide, zinc oxide, silica, magnesium oxide, alumina, chromium oxide, barium sulfate, calcium carbonate, calcium hydroxide and lead oxide described in JP-A 5-226112, inorganic solids having a high relative dielectric constant described in JP-A 6-68963, for instance, barium titanate, strontium titanate and potassium niobate, and the like.

For voltage resistance improvements, the thermistor of the invention may contain boron carbide described in JP-A 4-74383, etc.

For strength improvements, the thermistor of the invention may contain hydrated alkali titanate described in JP-A 5-74603, titanium oxide, iron oxide, zinc oxide and silica described in JP-A 8-17563, etc.

As a crystal nucleator, the thermistor of the invention may contain alkali halide and melamine resin described in JP-B 59-10553, benzoic acid, dibenzylidenesorbitol and metal benzoates described in JP-A 6-76511, talc, zeolite and dibenzylidenesorbitol described in JP-A 7-6864, sorbitol derivatives (gelling agents), asphalt and sodium bis(4-t-butylphenyl) phosphate described in JP-A 7-263127, etc.

As an arc-controlling agent, the thermistor of the invention may contain alumina and magnesia hydrate described in JP-B 4-28744, metal hydrates and silicon carbide described in JP-A 61-250058, etc.

As a preventive for the harmful effects of metals, the thermistor of the invention may contain Irganox MD1024 (Ciba-Geigy) described in JP-A 7-6864, etc.

As a flame retardant, the thermistor of the invention may contain diantimony trioxide and aluminum hydroxide described in JP-A 61-239581, magnesium hydroxide described in JP-A 5-74603, a halogen-containing organic compound (including a polymer) such as 2,2-bis(4-hydroxy-3,5-dibromophenyl)propane and polyvinylidene fluoride (PVDF), a phosphorus compound such as ammonium phosphate, etc.

In addition to these additives, the thermistor of the invention may contain zinc sulfide, basic magnesium carbonate, aluminum oxide, calcium silicate, magnesium silicate, aluminosilicate clay (mica, talc, kaolinite, montmorillonite, etc.), glass powders, glass flakes, glass fibers, calcium sulfate, etc.

The above additives should be used in an amount of up to 25% by weight of the total weight of the polymer matrix, low-molecular organic compound and conductive particles.

EXAMPLE

The present invention will now be explained more specifically with reference to examples, and comparative examples.

Example 1

High-density polyethylene (HY 540 made by Nippon Polychem Co., Ltd. with an MFR of 1.0 g/10 min. and a melting point of 135° C.) was used as the polymer matrix, microcrystalline wax (Hi-Mic-1080 made by Nippon Seiro Co., Ltd. with a melting point of 83° C.) as the low-molecular organic compound, and filamentary nickel powders (Type 255 Nickel Powder made by INCO Co., Ltd.) as the conductive particles. The conductive particles had an average particle diameter of 2.2 to 2.8 $\mu$m, an apparent density of 0.5 to 0.65 g/cm$^3$, and a specific surface area of 0.68 m$^2$/g.

The high-density polyethylene was milled with the nickel powders at a weight of four times as large as the polyethylene in a mill at 150° C. for 5 minutes. The mixture was further milled with the addition thereto of the wax at a weight of 1.5 times as large as the polyethylene and the nickel powders at a weight of 4 times as large as the wax. For a further 60 minutes, the mixture was milled together with the dropwise addition thereto of the silane coupling agent or vinylethoxysilane (KBE1003 made by The Shin-Etsu Chemical Co., Ltd.) in an amount of 1.0% by weight of the total weight of the polyethylene and the wax and an organic peroxide or 2,2-di-(t-butylperoxy)butane (Trigonox D-T50 made by Kayaku Akuzo K. K.) in an amount of 20% by weight of the vinyltriethoxysilane.

The milled mixture was pressed at 150° C. into a 1.1-mm thick sheet by means of a heat pressing machine. Then, the sheet was immersed in an aqueous emulsion containing 20% by weight of dibutyltin dilaurate (Tokyo Kasei K. K.) for an 8-hour crosslinking treatment at 65° C.

After drying, 30-$\mu$m thick Ni foil electrodes were compressed at 150° C. to both sides of the thus crosslinked sheet using a heat pressing machine to obtain a pressed sheet having a total thickness of 1 mm. Then, this sheet was punched out into a disk form of 10 mm in diameter to obtain a thermistor element, a section of which is shown in FIG. 1. As shown in FIG. 1, a thermistor element sheet 12 that was a milled molded sheet containing the low-molecular organic compound, polymer matrix and conductive particles was sandwiched between electrodes 11 formed of Ni foils.

Figure 2:
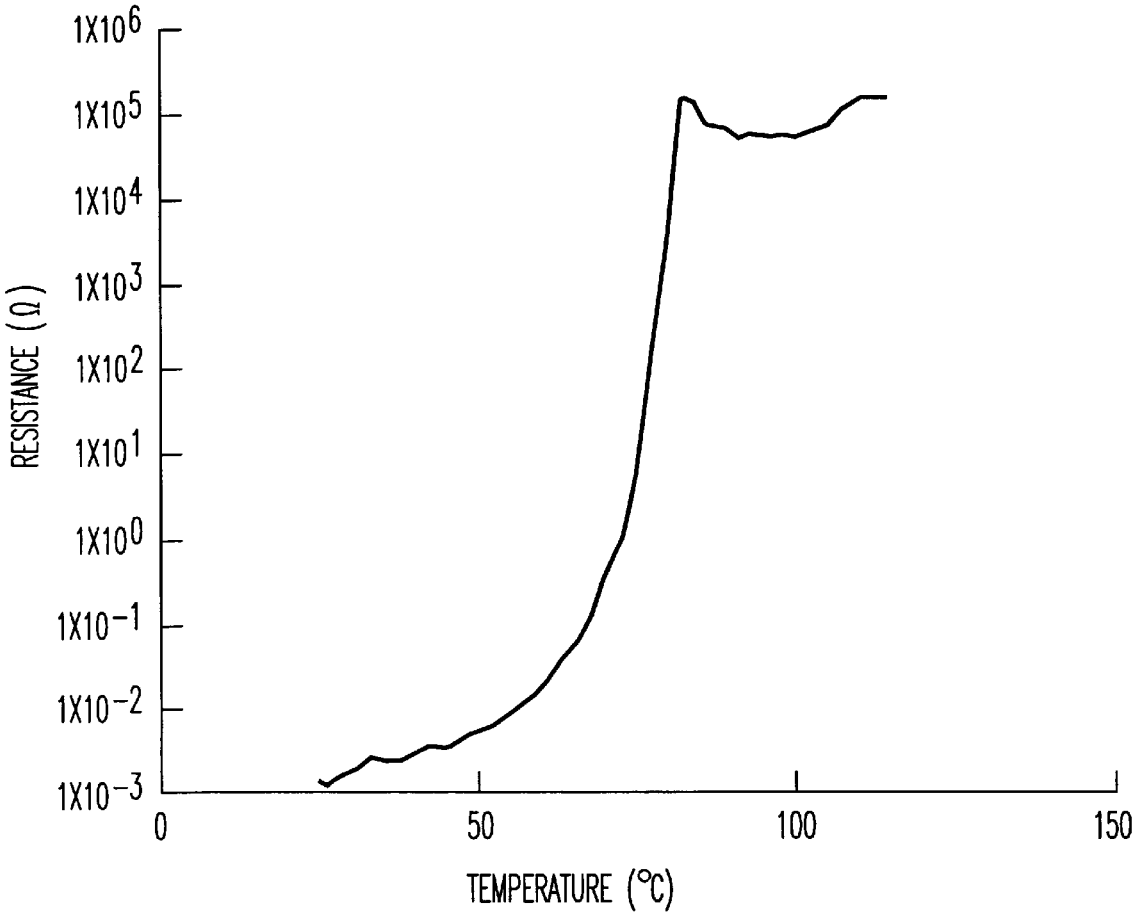
FIG. 2 is a temperature vs. resistance curve for the thermistor element in Example 1.

The element was heated and cooled in a thermostat, and measured for resistance value at a given temperature by the four-terminal method to obtain a temperature vs. resistance curve. The results are plotted in FIG. 2.

The resistance value at room temperature (25° C.) was $2.0\times10^{-3}$ Ω ($1.6\times10^{-2}$ Ωcm) with a sharp resistance rise at around 75° C., and the maximum resistance value was $1.6\times10^{5}$ Ω ($1.3\times10^{6}$ Ωcm). The rate of resistance change was 7.9 order of magnitude.

Figure 3:
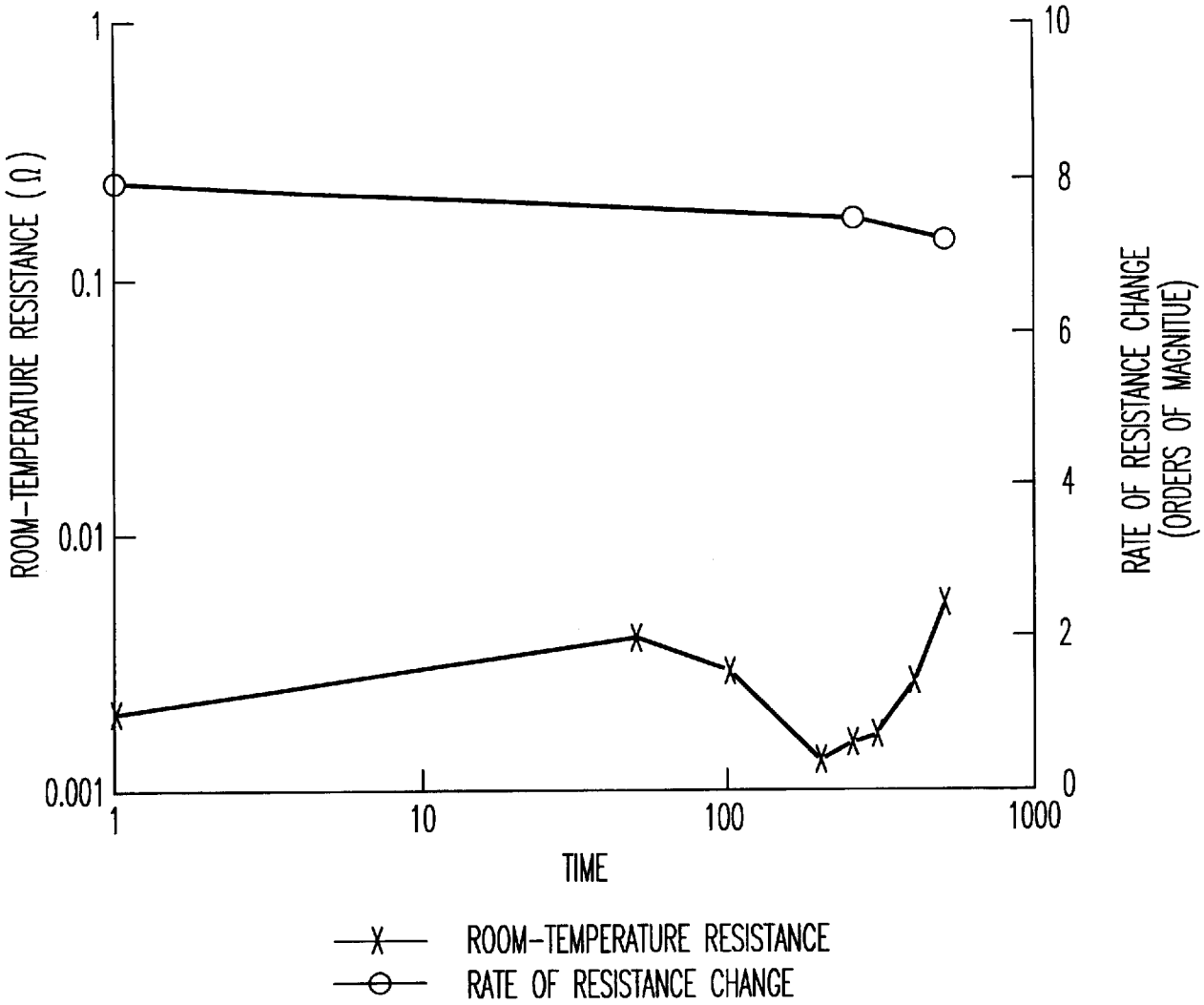
FIG. 3 is a graph illustrating the room-temperature resistance and rate of resistance change of the thermistor element in Example 1 at varying times when allowed to stand in accelerated testing at 80° C. and 80% RH.

This element was allowed to stand alone in a combined thermostat and humidistat preset at 80° C. and 80% RH for accelerated testing. FIG. 3 is a graph illustrating the room-temperature resistance and the rate of resistance change at some testing times. After the elapse of 500 hours, the resistance value at room temperature (25° C.) was $5.3\times10^{-3}$ Ω ($4.2\times10^{-2}$ Ωcm) while the rate of resistance change was 7.2 orders of magnitude. Thus, both the room-temperature resistance value and the rate of resistance change remained substantially unchanged; sufficient PTC performance was well maintained.

The 500-hour accelerated testing at 80° C. and 80% RH is tantamount to a humidity-dependent operating life of 20 years or longer at Tokyo, and a humidity-dependent operating life of 10 years or longer at Naha, as calculated on an absolute humidity basis. The calculation on an absolute humidity basis is explained with reference to the conversion from the operating life under 80° C. and 80% RH conditions to the operating life under 25° C. and 60% RH conditions. The absolute humidity at 80° C. and 80% RH is 232.5 g/m$^3$ while the absolute humidity at 25° C. and 60% RH is 13.8 g/m$^3$. Here assume the acceleration constant is 2. Then, $(232.5/13.8)^2$ is approximately equal to 283.85. If, in this case, the operating life is 500 hours under the 80° C. and 80% RH conditions, then the operating life under the 25° C. and 60% RH conditions is 500 hours×283.85≈141,925 hours≈5,914 days≈16.2 years It is here to be noted that the year-round humidity at Tokyo, and Naha is given by the sum of each average month-long relative humidity as calculated on an absolute humidity basis.

Example 2

A thermistor element was obtained as in Example 1 with the exception that paraffin wax (HNP-10 made by Nippon Seiro Co., Ltd. with a melting point of 75° C.) was used as the low-molecular, water-insoluble organic compound. A temperature vs. resistance curve was obtained and accelerated testing was carried out as in Example 1.

This element had a resistance value of $2.0\times10^{-3}$ Ω ($1.6\times10^{-2}$ Ωcm) at room temperature (25° C.), and showed a sharp resistance rise at around 75° C. with a maximum resistance value of $7.7\times10^{6}$ Ω ($6.0\times10^{7}$ Ωcm) and a rate of resistance change of 9.6 orders of magnitude.

In the 80° C. and 80% RH accelerated testing, the room-temperature resistance value was $6.2\times10^{-3}$ Ω ($4.9\times10^{-2}$ Ωcm) after the elapse of 500 hours, with the rate of resistance value being 8.7 orders of magnitude. Thus, both the room-temperature resistance value and the rate of resistance value remained substantially unchanged; sufficient PTC performance was well maintained.

Example 3

A thermistor element was obtained as in Example 1 with the exception that high-density polyethylene (HY420 made by Nippon Polychem Co., Ltd. with an MFR of 0.4 g/10 min. and a melting point of 134° C.) was used as the polymer matrix. A temperature vs. resistance curve was obtained and accelerated testing was carried out as in Example 1.

This element had a resistance value of $4.0\times10^{-3}$ Ω ($3.1\times10^{-2}$ Ωcm) at room temperature (25° C.), and showed a sharp resistance rise at around 75° C. with a maximum resistance value of $6.0\times10^{4}$ Ω ($4.7\times10^{5}$ Ωcm) and a rate of resistance change of 7.2 orders of magnitude.

In the 80° C. and 80% RH accelerated testing, the room-temperature resistance value was $7.5\times10^{-3}$ Ω ($5.9\times10^{-2}$ Ωcm) after the elapse of 500 hours, with the rate of resistance value being 6.5 orders of magnitude. Thus, both the room-temperature resistance value and the rate of resistance value suffered from no or little variation; sufficient PTC performance was well maintained.

Comparative Example 1

A thermistor element was obtained as in Example 1 with the exception of no addition of the silane coupling agent and organic peroxide, and no crosslinking treatment. A temperature vs. resistance curve for this sample was obtained as in Example 1. This element had a resistance value of $3.0\times10^{-3}$ Ω ($2.4\times10^{-2}$ Ωcm) at room temperature (25° C.), and showed a sharp resistance rise at around 75° C. with a maximum resistance value of $8.2\times10^{4}$ Ω ($6.4\times10^{5}$ Ωcm) and a rate of resistance change of 7.4 orders of magnitude.

Figure 4:
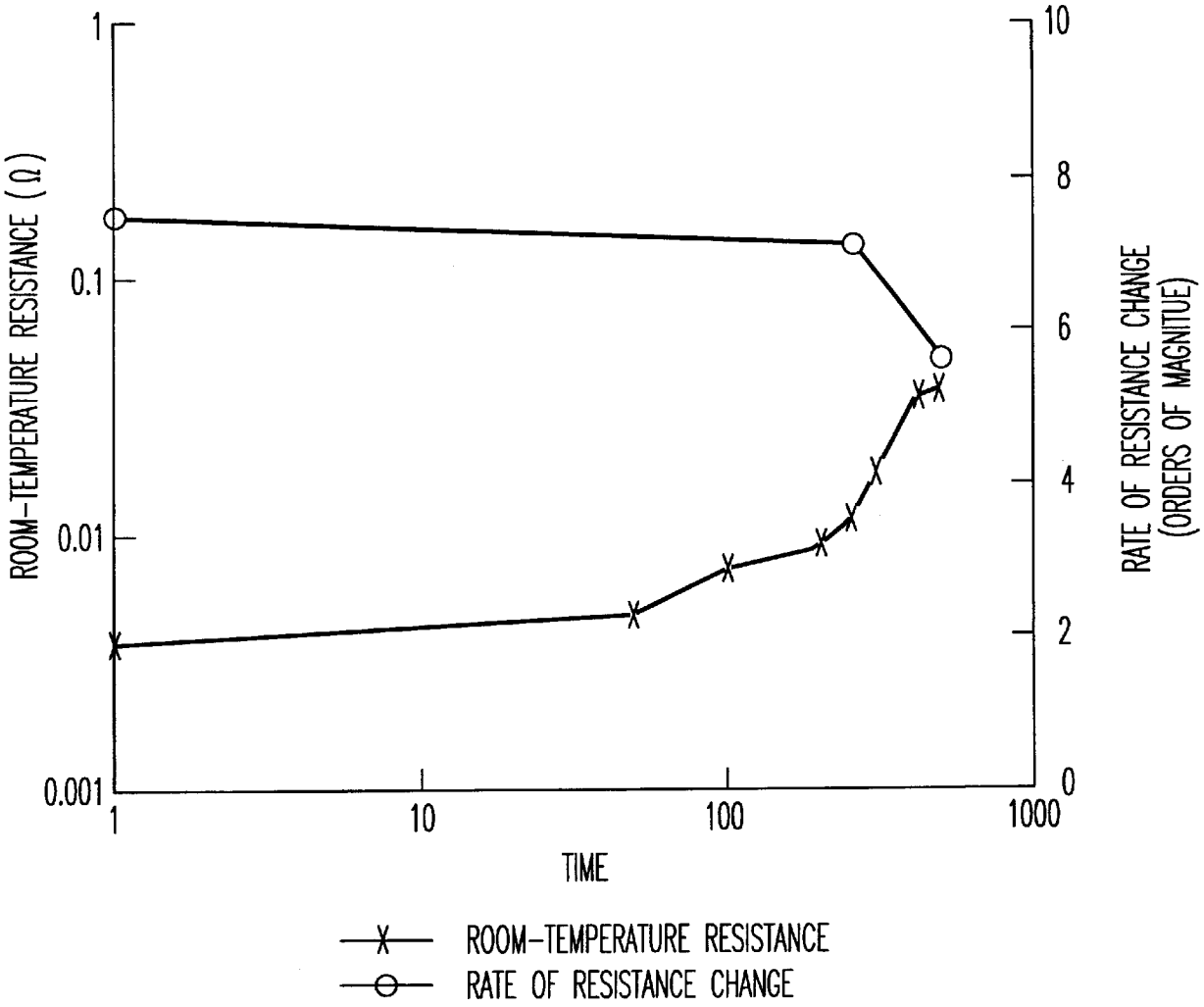
FIG. 4 is a graph illustrating the room-temperature resistance and rate of resistance change of the thermistor element in Comparative Example 1 at varying times when allowed to stand in accelerated testing at 80° C. and 80% RH.

Using this element, accelerated testing was carried out at 80° C. and 80% RH as in Example 1. The room-temperature resistance and the rate of resistance change at some testing times are shown in FIG. 4. After the passage of 500 hours, the room-temperature resistance value was $3.4\times10^{-2}$ Ω ($2.7\times10^{-1}$ Ωcm) that was 10 times as large as the initial value, and the rate of resistance change decreased to 5.4 orders of magnitude.

Comparative Example 2

A thermistor element was obtained as in Example 2 with the exception of no addition of the silane coupling agent and organic peroxide, and no crosslinking treatment. A temperature vs. resistance curve for this sample was obtained and accelerated testing was carried out as in Example 1.

This element had a resistance value of $2.0\times10^{-3}$ Ω ($1.6\times10^{-2}$ Ωcm) at room temperature (25° C.), and showed a sharp resistance rise at around 75° C. with a maximum resistance value of $8.0\times10^{7}$ Ω ($6.3\times10^{8}$ Ωcm) and a rate of resistance change of 10.6 orders of magnitude.

In the 80° C. and 80% RH accelerated testing, the room-temperature resistance value was 7.7 Ω (60.5 Ωcm) with a rate of resistance change of 7.1 orders of magnitude. Thus, some considerable degradation in both the room-temperature resistance value and the rate of resistance change was observed.

Comparative Example 3

A thermistor element was obtained as in Example 1 with the exception that low-density polyethylene (LC500 made by Nippon Polychem Co., Ltd. with an MFR of 4.0 g/10 min. and a melting point of 106° C.) was used as the polymer matrix. A temperature vs. resistance value was obtained and accelerated testing was conducted as in Example 1.

This element had a resistance value of $3.0\times10^{-3}$ Ω ($2.4\times10^{-2}$ Ωcm) at room temperature (25° C.), and showed a sharp resistance rise at around 80° C. with a maximum resistance value of $1.0\times10^{9}$ Ω ($7.8\times10^{9}$ Ωcm) and a rate of resistance change of 11 orders of magnitude greater.

In the 80° C. and 80% RH accelerated testing, a maximum resistance value of $1.0\times10^{9}$ Ω or greater was found after the passage of 100 hours. However, the room-temperature resistance value was considerably increased to $7.0\times10^{-1}$ Ω (5.5 Ωcm).

Comparative Example 4

A thermistor element was obtained as in Example 1 with the exception that high-density polyethylene (HJ360 made by Nippon Polychem Co., Ltd. with an MFR of 6.0 g/10 min. and a melting point of 131° C.) was used as the polymer matrix. A temperature vs. resistance value was obtained and accelerated testing was conducted as in Example 1.

This element had a resistance value of $3.8\times10^{-3}$ Ω ($3.0\times10^{-2}$ Ωcm) at room temperature (25° C.), and showed a sharp resistance rise at around 75° C. with a maximum resistance value of $8.0\times10^{6}$ Ω ($6.3\times10^{7}$ Ωcm) and a rate of resistance change of 9.3 orders of magnitude.

In the 80° C. and 80% RH accelerated testing, the room-temperature resistance value after the passage of 500 hours was $6.4\times10^{-3}$ Ω ($5.0\times10^{-2}$ Ωcm) on a substantially similar level to the initial value. However, there was no initially observed, clear point of resistance value transition although the resistance value increased with increasing temperature. The resistance value at 75° C. was $1.3\times10^{-1}$ Ω; the rate of resistance change from that at room temperature was 1.3 orders of magnitude.

Set out in Table 1 are the room-temperature resistance values and rates of resistance change of the elements of Examples 1 to 3 and Comparative Examples 1 to 4, as measured before and after accelerated testing, together with the melt flow rate (MFR) of the polymer matrices and the melting point (mp) of the low-molecular organic compounds.

TABLE 1

| | Polymer Matrix | Low-Molecular Organic Compound (mp) | Silane Cross-linking | Room-Temp. Resistance Value (Ω) Initial | Room-Temp. Resistance Value (Ω) After Testing | Rate of Resistance Value** Initial | Rate of Resistance Value** After Testing |
|---|---|---|---|---|---|---|---|
| Example 1 | HD Polyethylene (MFR = 1.0) | Microcrystalline Wax 83° C. | Crosslinked | $2.0\times10^{-3}$ | $5.3\times10^{-3}$ | 7.9 | 7.2 |
| Example 2 | HD Polyethylene (MFR = 1.0) | Paraffin Wax 75° C. | Crosslinked | $2.0\times10^{-3}$ | $6.2\times10^{-3}$ | 9.6 | 8.7 |
| Example 3 | HD Polyethylene (MFR = 0.4) | Microcrystalline Wax 83° C. | Crosslinked | $4.0\times10^{-3}$ | $7.5\times10^{-3}$ | 7.2 | 6.5 |
| Comp. Ex. 1 | HD Polyethylene (MFR = 1.0) | Microcrystalline Wax 83° C. | Not Crosslinked | $3.0\times10^{-3}$ | $3.4\times10^{-2}$ | 7.4 | 5.4 |
| Comp. Ex. 2 | HD Polyethylene (MFR = 1.0) | Paraffin Wax 75° C. | Not Crosslinked | $2.0\times10^{-3}$ | 7.7 | 10.6 | 7.1 |
| Comp. Ex. 3 | LD Polyethylene (MFR = 4.0) | Microcrystalline Wax 83° C. | Crosslinked | $3.0\times10^{-3}$ | $7.0\times10^{-1}$* | ≧11 | ≧9* |
| Comp. Ex. 4 | HD Polyethylene (MFR = 6.0) | Microcrystalline Wax 83° C. | Crosslinked | $3.8\times10^{-3}$ | $6.4\times10^{-3}$ | 9.3 | — |

HD is an abbreviation of high density, and LD is an abbreviation of low density.

TABLE 1-continued

| Polymer Matrix | Low-Molecular Organic Compound (mp) | Silane Cross-linking | Room-Temp. Resistance Value (Ω) | | Rate of Resistance Value** | |
|---|---|---|---|---|---|---|
| | | | Initial | After Testing | Initial | After Testing |

*After the passage of 100 hours
Orders of magnitude

When vinyltrimethoxysilane was used as the silane coupling agent in Examples 1 to 3, too, the results were equivalent to those obtained in Examples 1 to 3. When γ-methacryloxypropyltrimethoxysilane, and γ-methacryloxypropyltriethoxysilane were used, too, similar results were obtained.

EFFECTS OF THE INVENTION

According to the present invention, it is thus possible to provide an organic positive temperature coefficient thermistor that has sufficiently low resistance at room temperature and a large rate of resistance change between an operating state and a non-operating state, and can be operated at less than 100° C. with a reduced temperature vs. resistance curve hysteresis, ease of control of operating temperature, and high performance stability.

What we claims is:

1. An organic positive temperature coefficient thermistor comprising a thermoplastic polymer matrix, a low-molecular organic compound having a melting point that is equal to or greater than 40° C. and less than 100° C. and conductive particles, each having spiky protuberances, wherein:

a mixture of said thermoplastic polymer matrix, said low-molecular organic compound and said conductive particles is crosslinked with a silane coupling agent comprising a vinyl group or a (meth)acryloyl group and an alkoxy group.

2. The organic positive temperature coefficient thermistor according to claim 1, wherein said low-molecular organic compound has a weight-average molecular weight of 1,000 or lower.

3. The organic positive temperature coefficient thermistor according to claim 1, wherein said low-molecular organic compound is a petroleum wax.

4. The organic positive temperature coefficient thermistor according to claim 1, wherein said conductive particles, each having spiky protuberances, are interconnected in a chain form.

5. The organic positive temperature coefficient thermistor according to claim 1, wherein said thermoplastic polymer matrix is a polyolefin.

6. The organic positive temperature coefficient thermistor according to claim 5, wherein said polyolefin is a high-density polyethylene.

7. The organic positive temperature coefficient thermistor according to claim 6, wherein said high-density polyethylene has a melt flow rate of 3.0 g/10 min. or less.

8. The organic positive temperature coefficient thermistor according to claim 1, wherein said silane coupling agent is vinyltrimethoxysilane or vinyltriethoxysilane.

9. The organic positive temperature coefficient thermistor according to claim 1, which has an operating temperature of less than 100° C.

10. A method of preparing an organic positive temperature coefficient thermistor as recited in claim 1, wherein a thermoplastic polymer matrix, a low-molecular organic compound having a melting point that is equal to or greater than 40° C. and less than 100° C. and conductive particles, each having spiky protuberances, are milled together into a milled mixture, and said milled mixture is then crosslinked with a silane coupling agent comprising a vinyl group or a (meth)acryloyl group and an alkoxy group.

* * * * *